United States Patent [19]

Simons et al.

[11] Patent Number: 4,899,678

[45] Date of Patent: Feb. 13, 1990

[54] METHOD AND APPARATUS FOR TESTING SEWING THREAD

[75] Inventors: Frank H. Simons, Charlotte, N.C.; Carl N. Black, Ft. Mill, S.C.

[73] Assignee: Hoechst Celanese Corporation, Somerville, N.J.

[21] Appl. No.: 331,158

[22] Filed: Mar. 31, 1989

[51] Int. Cl.[4] ..... D05B 97/00

[52] U.S. Cl. ..... 112/262.1; 112/1

[58] Field of Search ..... 112/262.1, 266.1, 1, 112/400, 402; 73/160

[56] References Cited

U.S. PATENT DOCUMENTS

| | | | |
|---|---|---|---|
| 795,290 | 7/1905 | Lowry | 112/1 X |
| 1,009,806 | 11/1911 | Thompson | 112/402 X |
| 1,304,811 | 5/1919 | Schick, Jr. | 112/402 X |
| 4,519,332 | 5/1985 | Fukuda | 73/160 X |
| 4,798,152 | 1/1989 | Simons et al. | 73/160 X |

*Primary Examiner*—H. Hampton Hunter

*Attorney, Agent, or Firm*—Forrest D. Stine

[57] ABSTRACT

The present invention permits the testing of the sewing characteristics of various types of sewing threads under conditions which simulate the normal conditions encountered when performing various fabric seaming operations in the conventional manner. The testing of the sewing characteristics of the sewing threads is carried out in an economical manner by using narrow test strip fabric so that the test results can be ascertained in a short period of time. The method and apparatus of the present invention permits various types of sewing threads to be subjected to the identical and repeatable conditions so that an accurate comparison of the sewing characteristics can be made. The sewing thread test can be carried out on relatively inexpensive narrow test fabric strips which are fed to and past the stitching needle of the sewing machine in various angular paths of travel relative to the needle and at preselected variable speed rates.

9 Claims, 4 Drawing Sheets

METHOD AND APPARATUS FOR TESTING SEWING THREAD

FIELD OF THE INVENTION

This invention relates generally to a method and apparatus for testing the sewing characteristics of various types of sewing threads, and more particularly to such a method and apparatus which permits testing of sewing threads in an economical manner by simulating certain of the conditions normally encountered when performing various fabric seaming operations in the formation of garments.

BACKGROUND OF THE INVENTION

To reduce the labor costs involved in producing various types of garments, many garment manufacturers now employ complicated and expensive automatic sewing devices, such as the automated pocket setter currently being used to attach the rear pockets to blue jeans. These automatic pocket setters move the pocket and the blue jean body portion along paths of travel extending at various angles relative to the vertically reciprocal needle of a sewing machine to produce multidirectional seams around the sides of the blue jean pocket. If the multidirectional seams produced by a particular type of sewing thread include an objectionable number of defects, the garment manufacturer will use the automatic pocket setter to test other types of sewing threads to determine the best type of sewing thread to use in this particular type of sewing operation.

In order to obtain meaningful results, it is often times necessary to seam a large number of pockets to the corresponding body portions of the blue jeans with several different types of sewing threads. This testing procedure requires that the automatic pocket setter be out of normal production for an extended period of time. Also, a large number of pockets and body sections must be provided to carry out this type of sewing thread testing operation under actual production conditions, thereby wasting many expensive pockets and blue jean body portions. Testing the sewing characteristics of sewing thread by actually sewing large numbers of pockets on the automatic pocket setter also takes a great amount of time to determine the type of sewing thread which produces the best results.

SUMMARY OF THE INVENTION

With the foregoing in mind, it is an object of the present invention to provide a method and apparatus for testing the sewing characteristics of various types of sewing threads by means of a simple and inexpensive apparatus for feeding and guiding narrow test strip fabric in a predetermined angular path of travel relative to the reciprocating needle of a sewing machine and at a preselected rate of travel while forming a seam with a particular type of sewing thread and in a manner simulating the normal conditions encountered when performing various seaming operations in an automatic seaming operation. The test can be repeated in an economical and expeditious manner and under the exact same conditions, but using different types of sewing threads, to determine which type of sewing thread produces the most commercially acceptable seam.

The present sewing thread testing apparatus is adapted for use with a conventional type of sewing machine having a vertically reciprocating needle and includes supply means for continuously supplying narrow test strip fabric of the type normally subjected to the seaming operation, guide means for guiding the test strip fabric in a predetermined angular path of travel relative to the vertically reciprocating needle, and variable speed feed means for engaging the test strip fabric and moving the same at a preselected rate of travel to form a seam with a particular type of sewing thread so that the number of defects formed in the seam, by the particular sewing thread under the selected conditions, can be easily determined. The present sewing thread testing apparatus can be used to repeatedly form the same type of seam under identical operating test conditions and with various types of sewing threads so that the sewing characteristics of the individual sewing threads can be easily determined.

In one embodiment of the sewing thread testing apparatus, superposed test strip fabrics are withdrawn from convolute rolls of the fabric and engaged by transversely reciprocating means as the superposed test strip fabrics are guided longitudinally to and past the vertically reciprocating stitching needle of the sewing machine. The transversely reciprocating means is moved at a preselected speed while the test strip fabric is being moved therethrough at a preselected rate of travel to form a zigzag seam extending along the test strip fabric. The angular inclination of adjacent legs of the zigzag seam can be easily varied by changing the speed of reciprocation and/or changing the speed at which the test strip fabric is being fed.

In a second embodiment of the sewing thread testing apparatus, a single test strip fabric is withdrawn from a wound roll of the fabric and the test strip fabric is drawn through a strip folding guide to fold the same over upon itself and form a multi-layer test strip fabric as it passes beneath the vertically reciprocating needle. The conventional sewing machine is set to form a bar tack stitch with the position in which the vertically reciprocating needle penetrates the fabric being shogged back and forth. The folded test strip fabric is drawn through the folding guide at a selected rate of travel to form a simulated bar tack seam extending along the folded test strip fabric. The angular inclination of adjacent legs of the bar tack seam can be easily varied by changing the speed at which the folded test strip fabric is being drawn through the folding guide.

In a third embodiment of the sewing thread testing apparatus, the test strip fabric is withdrawn from a wound spool of the fabric and directed through a folding guide positioned to guide the folded test strip fabric beneath the vertically reciprocating needle and along an acute angular path of travel so that the fabric passes beneath the stitching needle at an oblique angle. The folded test strip fabric is drawn beneath the needle at a preselected rate of travel to form a straight seam extending along the folded test strip fabric.

In each of the illustrated embodiments, the sewing machine is supported in a sewing table so that the bed plate of the sewing machine is substantially flush with the top of the sewing table. Support means is attachable to the table for supporting one or more wound rolls of test strip fabric to be supplied to the sewing machine. The support means for the supply roll of narrow test strip fabric is adapted to clampingly engage the table so that it can be moved to various positions around the table. Variable speed feed means is also clampingly mounted on the table for engaging the test strip fabric and for moving the same at a preselected rate of travel to and past the stitching needle of the sewing machine. Test strip fabric guide means is mounted on the table and serves to guide the test strip fabric in a predetermined path of travel to and beneath the stitching needle of the sewing machine and then to the variable speed feed means. An inverter guide is positioned between the stitching needle of the sewing machine and the variable speed feed means for inverting the sewn test strip fabric so that the sewing machine operator may make a preliminary inspection by visually inspecting the bottom side of the sewn test strip fabric for the presence of any defects formed therein.

BRIEF DESCRIPTION OF THE DRAWINGS

Other objects and advantages will appear as the description proceeds when taken in connection with the accompanying drawings, in which—

DESCRIPTION OF THE PREFERRED EMBODIMENTS

Figure 1:
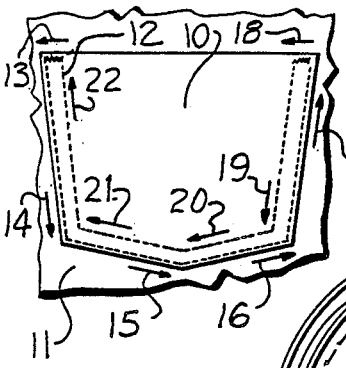
Fig-1 (PRIOR ART)
FIG. 1 is a somewhat schematic fragmentary plan view of a typical blue jean pocket and illustrating the manner in which the pocket is attached or stitched to the blue jean body portion by a known prior art type of automatic pocket setter.

FIG. 1 schematically illustrates the manner in which a blue jean pocket 10 is attached to a blue jean body portion 11 by means of a conventional automatic pocket setter, such as Pfaff Model 3518. This automatic pocket setter includes a conventional type of industrial sewing machine and a computer or cam controlled pattern of lines of stitching are formed around the sides of the pocket 10 while the pocket 10 is maintained in position on the body portion 11 and moved in various directions beneath the needle of the sewing machine to form the double seam, illustrated in dotted lines. For example, starting at location 12, a short line of stitching is formed upwardly to a position adjacent the upper edge of the pocket 10, along the upper edge of the pocket 10, as indicated by the arrow 13. The outside seam is formed around the pocket, in the direction of the arrows 14–17, up to a position adjacent the upper right-hand corner of the pocket 10. At this point, the needle of the sewing machine switches into a reciprocating or shogging mode to form a bar tack line of stitching extending in the direction of the arrow 18 at the upper end of the right-hand portion of the pocket 10.

The inner seam is then formed by forming the downwardly extending line of stitching, as indicated by the arrow 19. At the lower end of the right-hand corner of the pocket 10, a line of stitching is formed in the direction of the arrow 20. The inner seam is continued by forming the line of stitching in the direction of the arrow 21 and to the lower left-hand corner of the pocket 10. The inner seam is continued by forming the line of stitching extending upwardly along the left-hand side of the pocket 10 and in the direction of the arrow 22. At the upper left-hand corner of the pocket 10, the sewing machine then forms a bar tack row of stitching extending across from the inner to the outer seam and in the direction of the arrow 13 to complete the sewing of the pocket 10 onto the body portion 11 of the blue jean.

Thus, during the sewing of the pocket 10 to the body 11 of the blue jean, the automatic pocket setter feeds the pocket to and beneath the sewing needle in many different angular directions, relative to the vertically reciprocating needle so that the sewing thread being used is subjected to many different types of stresses and varying tensions as it passes through the eye of the needle and is engaged by the hook carried by the bobbin cage beneath the fabric. In some instances, the tension applied to the sewing thread as it passes through the needle eye causes twist in the sewing thread to back up so that the plies of the sewing thread untwist and separate in the loop forming area. If the plies of the sewing thread separate sufficiently, only one ply of the sewing thread may be caught by the hook on the bobbin cage so that a tangle is formed that appears on the surface of the fabric. In some instances, the twist backing up in the thread creates sufficient friction to cause the thread to break. Also, the increased tension in the thread at the eye of the needle can cause wrapper fibers in corespun yarn to be stripped off and create excessive lint problems and a weakened sewing thread.

Very rapid changes in sewing direction place additional strain on the sewing thread and also increase the likelihood of malformed or twisted needle thread loops, making proper capture of the needle thread by the bobbin hook more difficult. This seems to be a particular problem when changing sewing direction in such a manner that the backed up twist in the sewing thread is released very suddenly to cause the sewing thread to act like a torque lively thread. In some directions in which the pocket is moved relative to the needle, the needle thread not only loops around the bobbin thread, but also around itself in a half hitch, thereby putting more strain on the sewing thread as the stitch is set and increasing the likelihood of a misformed stitch. Since some automatic pocket setters continuously move the fabric relative to the needle, both while the needle is out of the fabric and penetrated in the fabric, certain directions of the movement of the fabric cause the needle and its thread loop to be deflected away from the hook on the bobbin cage, thereby making loop capture more difficult and loop formation more critical.

While various types of sewing threads can be tested under actual operating conditions by repeatedly supplying the automatic pocket setter with various types of sewing threads to determine a suitable sewing thread for sewing thereon, this is a very expensive and time consuming method of testing the sewing characteristics of several different types of sewing threads in actual operating conditions. For example, a very large number of pockets, sometimes as many as 1,000 pockets per sample, must be sewn to determine small differences produced in different types of sewing threads. When the automatic pocket setter is used to sew sample fabrics, the very expensive automatic pocket setter should be taken out of normal production, thereby resulting in a loss of production time for the automatic pocket setter. Because of the expense involved in the purchase of an automatic pocket setter, and the expense in maintaining the same, it is not economically feasible to purchase an automatic pocket setter to be used for sewing thread testing purposes only.

The method and apparatus of the present invention permits the testing of the sewing characteristics of various types of sewing threads under conditions which simulate the normal conditions encountered when performing various seaming operations with a sewing machine, such as attaching pockets to blue jeans by using an automatic pocket setter. The present testing apparatus is relatively inexpensive to produce, includes a very few simple parts which require very little maintenance, and can be operated to simulate the most difficult portions of the sewing operation carried out by an automatic pocket setter. The simulated conditions can be accurately reproduced for a reasonable cost and the results can be determined in a very short period of time. The testing apparatus utilizes inexpensive narrow test strip fabric and can create sewing conditions in a manner which is similar to the sewing conditions actually encountered in automatic pocket setters to provide for accelerated testing of various types of sewing threads to provide a prediction of the type of performance which will be experienced when these different types of sewing threads are provided for use on automatic pocket setters and the like.

Figure 2:
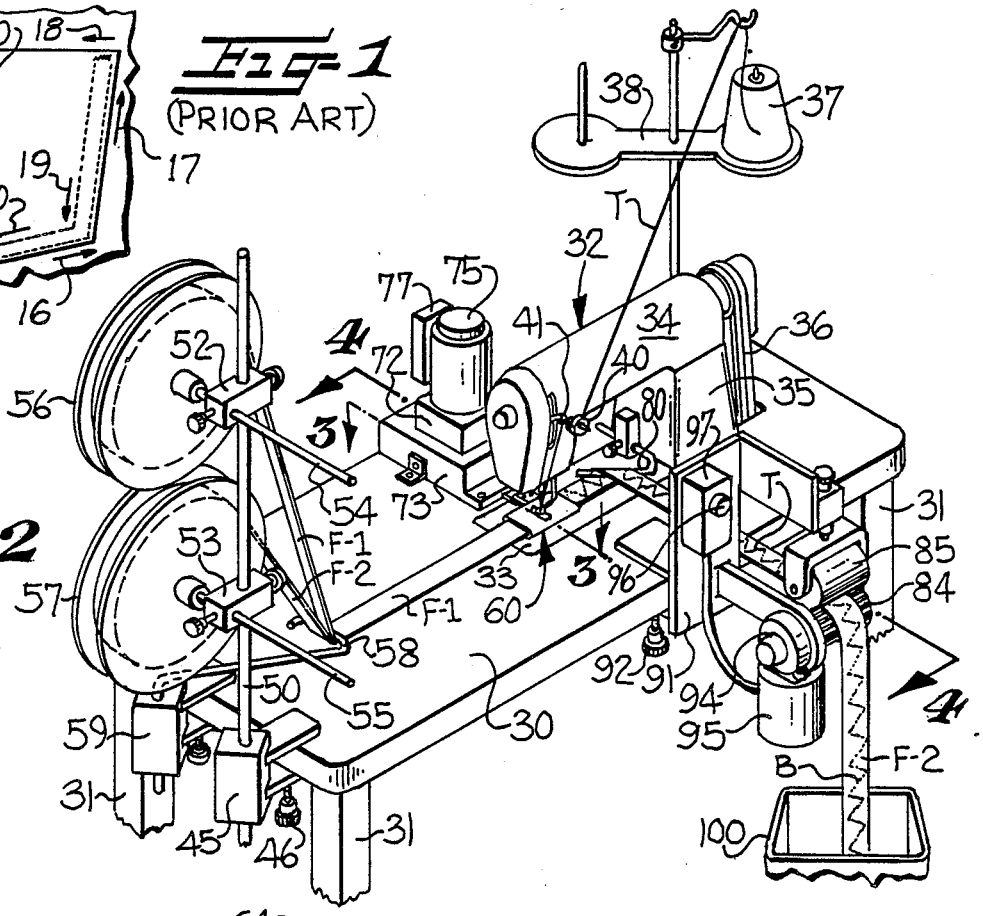
FIG. 2 is an isometric view of one embodiment of the present invention.
Figure 4:
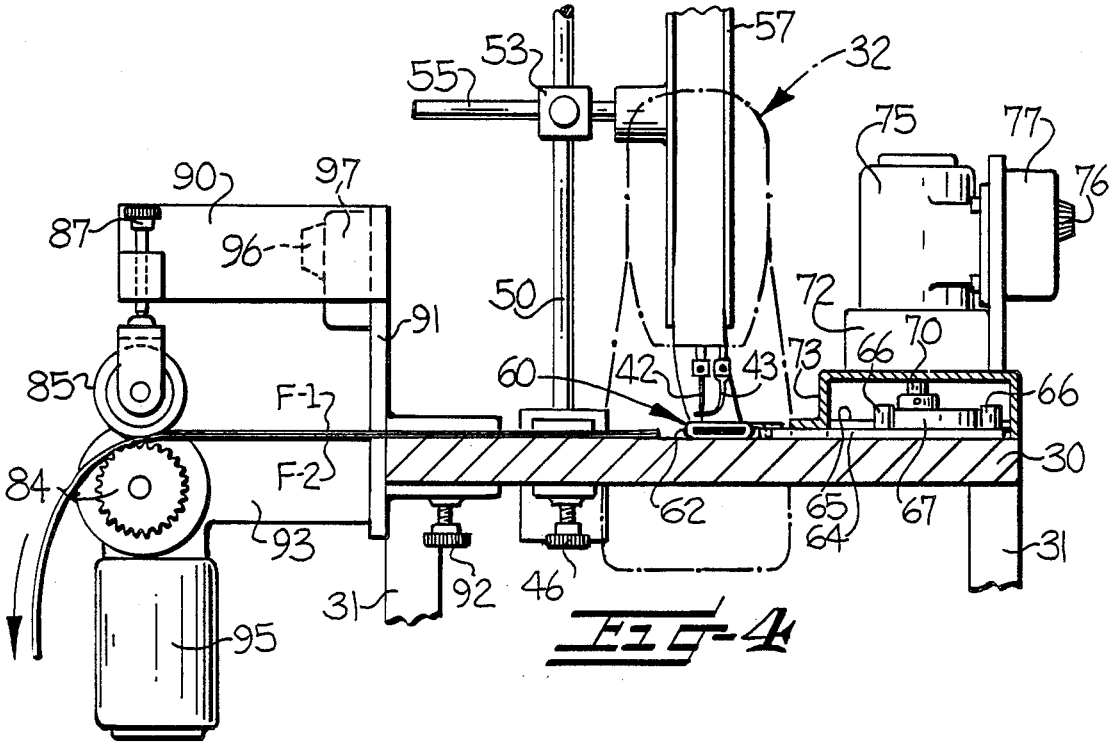
FIG. 4 is an enlarged vertical sectional view taken substantially along the line 4—4 in FIG. 2.

In the embodiment of the invention illustrated in FIG. 2, the sewing thread testing apparatus includes a table 30 supported on legs 31 having an opening in which a sewing machine, broadly indicated at 32, is supported. The sewing machine illustrated is of the type manufactured by Pfaff Model No. 419 and is of the type normally utilized in an automatic pocket setter. The sewing machine 32 has a lower portion extending through the opening in the table 30 (FIG. 4) and is provided with the usual work supporting base or bed supported in a substantially flush condition with the upper surface of the table 30. An overhanging arm 34 is supported on the upper end of a vertical standard 35 and the machine is driven by a belt drive 36, in the usual manner. Needle thread T is withdrawn from a supply package 37 supported on a suitable stand 38 and is directed to the sewing machine through a tension device 40, a reciprocating thread supply arm 41, and through the eye of the usual vertically reciprocating needle 42 (FIG. 4). A conventional guide or presser foot 43 is supported at its upper end on the sewing head and the lower end surrounds the vertically reciprocating needle 42.

A supply of test strip fabric is mounted on the table 30 by means of a clamp-on bracket 45 having outwardly extending legs positioned above and below the table 30 and a tightening adjustment screw 46 is provided in the lower leg for clamping the bracket 46 in the desired position around the periphery of the table 30. An upstanding support rod 50 is fixed at its lower end in the bracket 45 and extends upwardly therefrom to adjustably support respective upper and lower clamping blocks 52, 53 (FIG. 2) having clamping screws for supporting the blocks 52, 53 in vertically adjusted position on the support rod 50. Upper and lower horizontal support rods 54, 55 are supported for horizontal adjustment in the respective blocks 52, 53 and rotatably support respective upper and lower spools of convolutely wound narrow test strip fabric 56, 57. Test strip fabrics, F-1 and F-2 are withdrawn from the respective spools 56, 57 and are directed downwardly into superposed relationship and beneath the horizontal leg on the forward end of a test strip fabric guide rod 58. The rear end of the test strip guide rod 58 is supported in a clamp-on bracket 59 supported in adjusted position on the edge of the table 30.

The superposed test strip fabrics F-1 and F-2 are directed along the upper surface of the table 30 and toward the sewing machine needle 42 where they pass through a guide plate 62 of a transversely reciprocating means 60. The upper and lower surfaces of the guide plate 62 are provided with elongate slots or openings 63, in which the vertically reciprocating stitching needle 42 operates. One side of the guide plate 62 is fixed to one end of a reciprocating slide plate 64 mounted for sliding reciprocation in guide rails 65. The upper surface of the guide plate 64 is provided with cam engaging rollers 66 for engagement with opposite sides of an eccentric cam 67. The cam 67 is fixed on the lower end of a drive shaft 70 which forms the output shaft of a gear reduction unit 72 supported on a housing 73. The housing 73 is fixed on the table 30 and a drive motor 75 is supported on the gear reduction unit 72. The speed of the drive motor 72 may be varied by rotation of a control knob 76 (FIG. 4) mounted on a speed control box 77.

Figure 3:
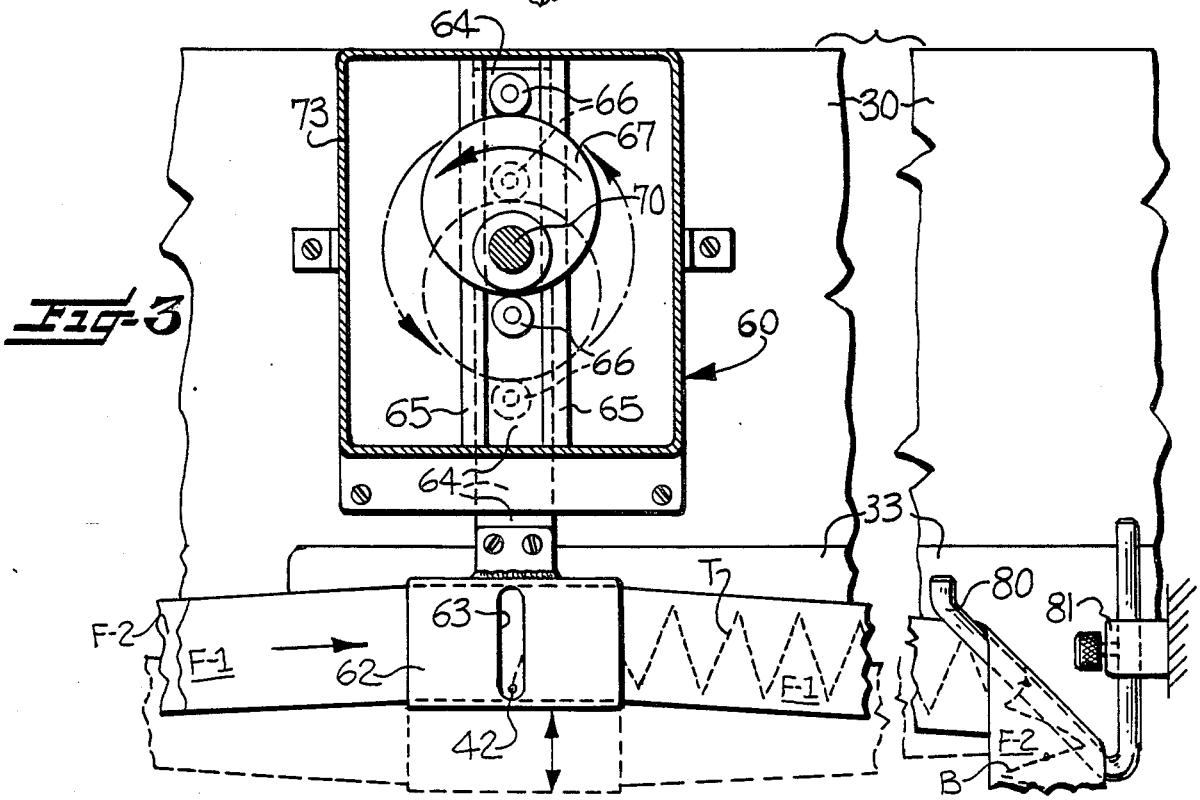
FIG. 3 is an enlarged fragmentary horizontal sectional view taken substantially along the line 3—3 in FIG. 2.

After the superposed test fabric strips F-1 and F-2 have been stitched together, in a manner to be presently described, they are guided beyond the needle 42 and pass around the horizontal leg on the outer end of an inverter guide rod 80, the inner end of which is adjustably supported in a support bracket 81, fixed on the vertical standard 35 of the sewing machine 32 (FIG. 3). As the sewn together test strip fabrics F-1 and F-2 move along the upper surface of the sewing machine bed 33, the stitches formed by the needle thread T are visible on the top or front face of the test strip fabrics. As the test strip fabrics extend around the horizontal leg of the inverter guide rod 80, the bottom or reverse side is visible.

Variable speed feed means is provided for engaging the test strip fabrics and for moving the same at a preselected rate of travel to and past the stitching needle 42 of the sewing machine 32. The feed means includes a fluted drive roll 84 (FIG. 4) over which the superposed test fabric strips F-2 and F-2 pass. A rubber covered idler roll 85 is supported above the fluted drive roll 84 and resiliently urges the test fabric strips F-1, F-2 into nippingly driving engagement between the rolls 84 and 85. The rubber covered roll 85 is supported for rotation in a mounting yoke 86 which is supported for vertical adjustment by an adjustment screw 87, supported in the outer end of a support arm 90. The other end of the support arm 90 is fixed on a clamping bracket 91 having support legs extending above and below the table 30 and the lower leg is provided with a clamping screw 92. A lower horizontal support arm 93 extends outwardly from the clamping bracket 91 and rotatably supports the fluted drive roll 94, a gear reduction unit 94 (FIG. 2)

and a drive motor 95. The speed of the drive motor 95 can be manually adjusted by rotation of a control knob 96, mounted on a control box 97 (FIG. 2).

Figure 5:
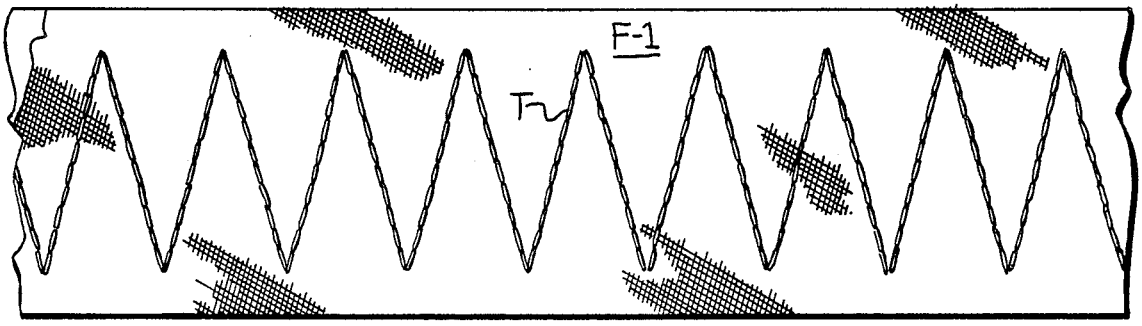
FIGS. 5 and 6 are enlarged fragmentary plan views of the superposed narrow strip fabric and illustrating a zigzag line of stitching applied to the respective front and reverse sides thereof, with the defects formed by the sewing thread being illustrated in FIG. 6.
Figure 6:
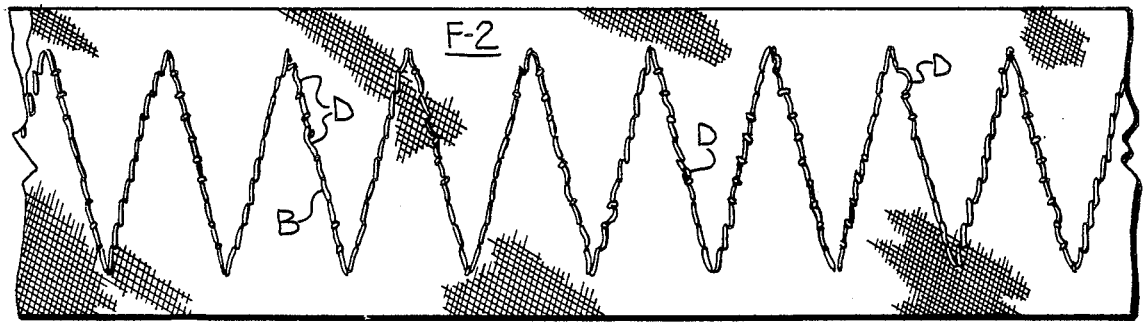

As the stitched together test strip fabrics F-1 and F-2 are drawn to and pass the stitching needle 42 of the sewing machine 32, by the fluted drive roll 84, they are taken up in any suitable manner, such as by being deposited in a collection bin 100, as illustrated in FIG. 2. As the superposed test strip fabrics F-1, F-2 are drawn through the guide plate 62 and beneath the needle 42, a two-thread line of stitching is formed connecting the test fabric strips together to form a zigzag line of stitching, as illustrated in FIGS. 5 and 6. The line of stitching on the top surface is formed by the needle thread T (FIG. 5) while the line of stitching on the bottom side is formed by a bobbin thread B (FIG. 6) which is fed from the usual bobbin cage of the sewing machine, not shown, in the usual manner. In the conventional formation of a two-thread stitch line, the needle thread T is fed through the eye of the needle 42 and penetrates the fabric where the bobbin thread B crosses the needle thread T as the needle thread T is engaged by the hook on the bobbin cage, in the usual manner.

The speed of reciprocation of the guide plate 62 and/or the speed at which the test fabric strips are drawn beneath the needle 42 can be varied to vary the angular relationship between the adjacent legs of the zigzag line of stitching to simulate the conditions encountered when sewing a pocket on an automatic pocket setter where the fabric is moved in various directions relative to the needle. Thus, as the test strip fabric is moved forwardly and in a sidewise direction, relative to the needle 42, as illustrated in FIG. 3, various stresses are placed on the sewing needle 42 as it penetrates the fabric and the sewing takes place while the fabric is moving in various directions so that the particular type of sewing thread being utilized may produce various defects, as indicated at D in FIG. 6.

By utilizing the present testing apparatus, it is possible to determine the number of defects which are produced by different types of sewing threads in an economical and quickly ascertainable manner, without requiring the use of an automatic pocket setter. The zigzag type of stitched line, as illustrated in FIGS. 5 and 6, represents the most extreme positions of stress under which the thread and needle is subjected to when using an automatic pocket setter. Other conditions simulating the normal conditions encountered when performing a seaming operation to connect a pocket to a body portion of blue jeans can be simulated by the apparatus disclosed in the other embodiments of the present invention.

Figure 7:
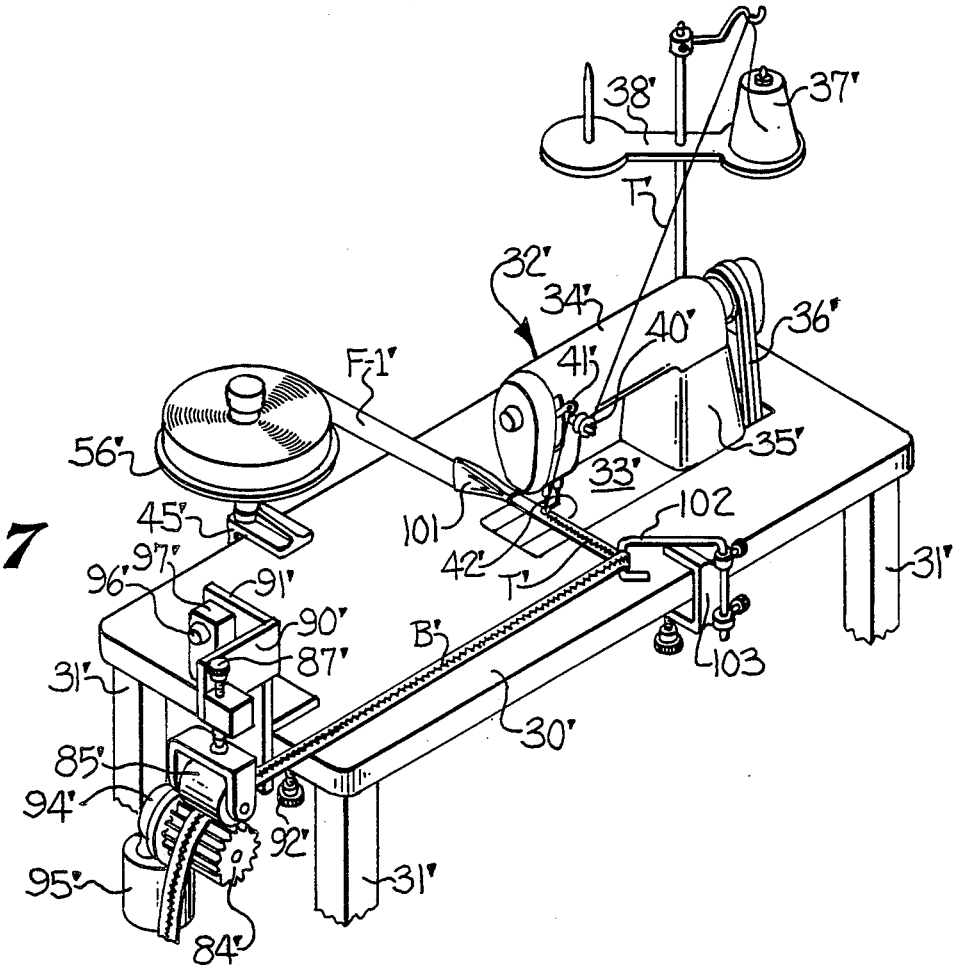
FIG. 7 is an isometric view of a second illustrated embodiment of the present invention.
Figure 8:
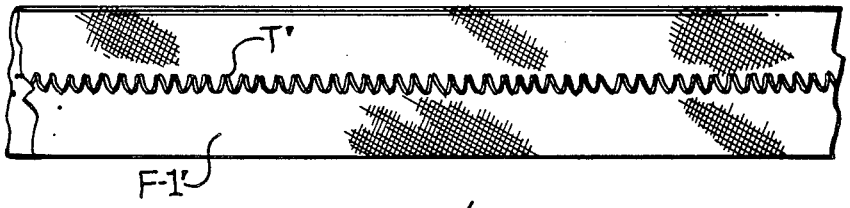
FIGS. 8 and 9 are fragmentary plan views of the respective front and rear sides of the folded test strip fabric and illustrating a bar tack type of line of stitching formed therealong, with the defects formed by the sewing thread being illustrated in FIG. 9.

In the embodiment of the invention illustrated in FIG. 7, the sewing thread testing apparatus includes many of the same parts as illustrated in the embodiment of FIGS. 2–4 and the same reference characters are applied to corresponding parts, with the prime notation added. However, in this embodiment, a single test strip fabric F-1′ is withdrawn from a convolutely wound roll 56′ supported for rotation on a clamping bracket 45′ clamped in the desired position on the table 30′. The single test strip fabric F-1′ is directed through a folding guide 101 which is fixed on the table 30 to fold the strip fabric material F-1 on itself and to guide the same from the rear to the front of the reciprocating needle 42′ toward the front of the table 30′. The horizontal leg of an inverter guide rod 102 is supported at its other end in a clamping bracket 103 supported on the table 30′. The forward end of the inverter guide rod 102 engages the folded and stitched strip fabric to invert the same so that the reversed or back side of the stitch folded strip fabric is visible as it is drawn across the top of the table 30′ and between the drive rolls 84′, 85′ by the variable speed feed means.

Figure 9:
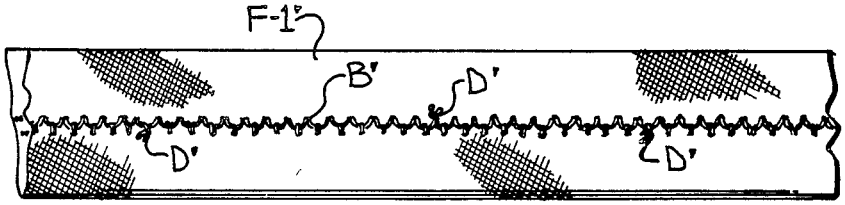

The line of stitching being formed in FIG. 7 simulates the normal conditions encountered when forming bar tack stitching, as illustrated by arrows 13 and 18 at the upper ends of the pocket shown in FIG. 1, when formed on an automatic pocket setter. The line of stitching formed on the top side of the folded strip of fabric F-1′ is formed by the needle thread T′ while the line of stitching formed on the reverse side of the strip fabric F-1′ (FIG. 9) is formed by the bobbin thread B′. While the folded test strip fabric F-1′ is fed in a straight line path beneath the needle 42′, the conventional sewing machine is set to form a zigzag stitch so that the needle 42 is shogged back and forth between alternate stitches or penetrations of the fabric to form the bar tack stitch configuration. Thus, the fabric being fed beneath the needle 42′ simulates the stress conditions normally encountered when forming a bar tack stitch configuration on an automatic pocket setter. The number of defects, as indicated at D′ in FIG. 9, can be determined for any particular type of sewing thread being tested. The results produced by one type of sewing thread can be compared to the type of results produced by other types of sewing threads and it can be determined which of the sewing threads produce the most commercially acceptable stitching.

Figure 10:
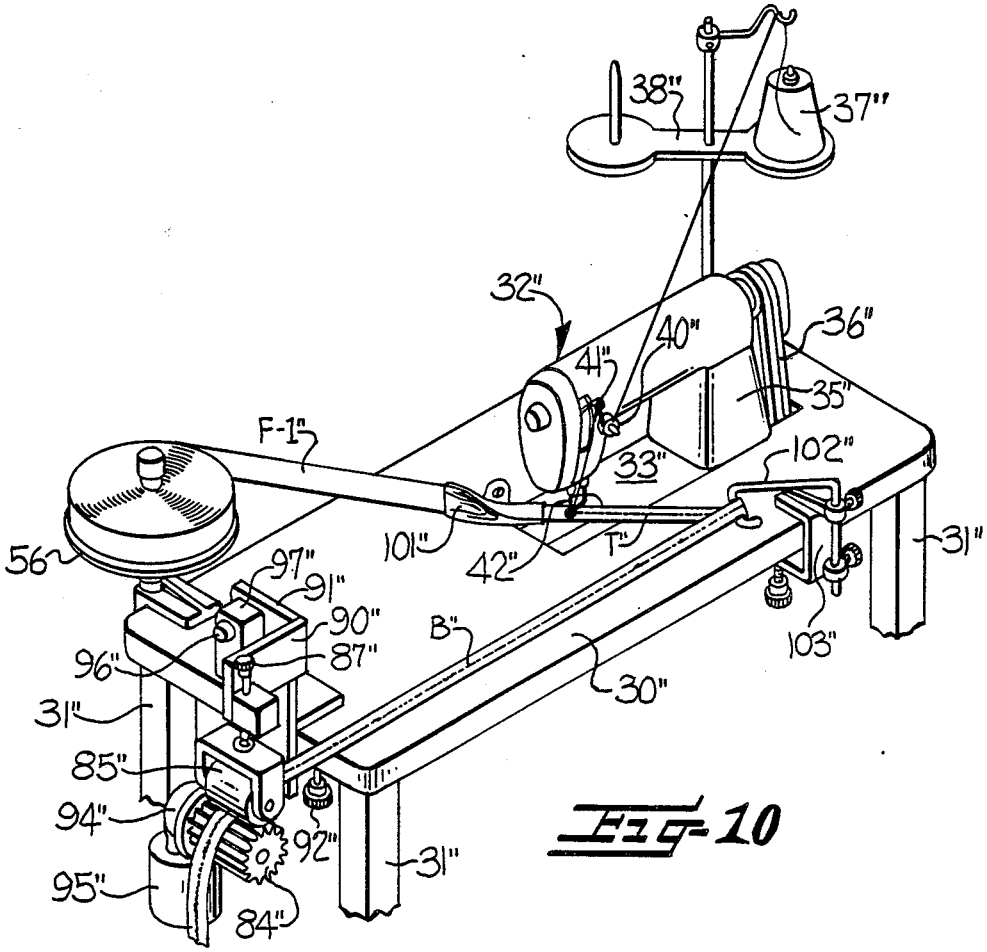
FIG. 10 is an isometric view of a third embodiment of the present invention.
Figure 11:
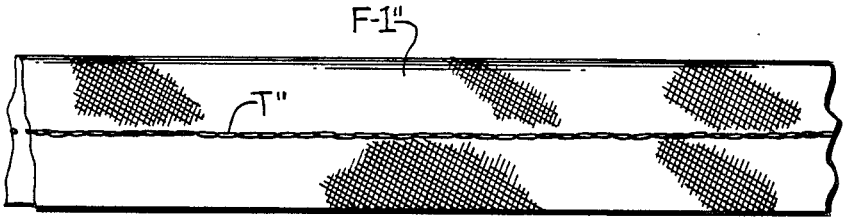
FIGS. 11 and 12 are fragmentary plan views of the respective front and reverse sides of a folded test strip fabric in which a straight seam has been formed, with the defects being formed by the sewing thread illustrated in FIG. 12.
Figure 12:
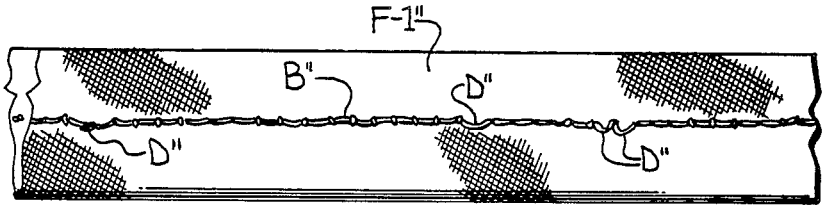

In the embodiment illustrated in FIG. 10, many of the same parts are employed as in the other two embodiments and corresponding parts bear like reference characters with the double prime notation added. In this embodiment, the test strip fabric F-1″ passes through the folding guide 101″ and beneath the needle 42″ to form a straight line of stitching while the folded test strip fabric is being drawn along an acute angular path of travel to and beneath the stitching needle 42′ at an oblique angle relative to the needle 42′. The sewn test strip fabric is inverted as it passes around the inverter guide rod 102″ and is taken up by the drive roll 84″ and the rubber covered roll 85″ of the variable speed feed means. Again, most of the defects, as indicated at D″, are formed on the bottom or reverse side of the folded fabric strips F-1″, as indicated in FIG. 12. The embodiment of FIG. 10 also simulates conditions encountered when sewing certain portions of the pocket onto the body portion of blue jeans by the use of an automatic pocket setter. The number of defects produced by different types of sewing threads can be determined in an economical and quickly ascertainable manner.

In each of the illustrated embodiments, the test strip fabric is illustrated as being drawn to and beneath the sewing needle of the sewing machine in a particular direction. However, it is to be understood that the positions of the test fabric strip supply and the variable speed feed means may be reversed by simply clamping these elements in the reverse positions on the table in order to test the sewing characteristics of several different types of sewing threads, when sewing in opposite directions. In certain instances, it may be necessary to test the sewing characteristics of several different types of sewing threads with only one of the embodiments of the invention illustrated.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. A method of testing the sewing characteristics of sewing thread for determining a suitable sewing thread for sewing a seam in a particular type of fabric with a sewing machine having a vertically reciprocable needle, said method comprising;

(1) providing a supply of test strip fabric corresponding to the particular type of fabric to be seamed, (2) selecting a sewing thread having characteristics that may be suitable for forming seams in the test strip fabric, (3) feeding the test strip fabric from the supply in a predetermined path of travel and at a preselected rate of travel underneath and past the vertically reciprocable needle of the sewing machine while forming stitching thereon, (4) collecting the sewn test strip fabric, (5) visually inspecting the collected sewn test strip fabric for defects in the stitching formed thereon and determining the suitability of the sewing thread for use with the test strip fabric; and (6) repeating steps 3 to 5 on the test strip fabric with at least one other selected sewing thread having different characteristics and which may be suitable for forming seams in the test strip fabric should it be determined from the visual inspection of the previously collected stitched test strip fabric that stitching defects present therein are commercially unacceptable.

2. A method of testing the sewing characteristics of sewing thread for determining a suitable sewing thread for sewing a seam in a particular type of fabric with a sewing machine having a vertically reciprocable needle, said method comprising;

(1) providing a supply of test strip fabric corresponding to the particular type of fabric to be seamed, (2) selecting a sewing thread having characteristics that may be suitable for forming seams in the test strip fabric, (3) feeding the test strip fabric by nippingly engaging the test strip fabric downstream of the sewing machine and pulling the test strip fabric from the supply at a preselected rate of travel to and past the sewing machine while forming stitching thereon, (4) collecting the sewn test strip fabric, (5) visually inspecting the collected sewn test strip fabric for defects in the stitching formed thereon and determining the suitability of the sewing thread for use with the test strip fabric; and (6) repeating steps 3 to 5 on the test strip fabric with at least one other selected sewing thread having different characteristics and which may be suitable for forming seams in the test strip fabric should it be determined from the visual inspection of the previously collected stitched test strip fabric that stitching defects present therein are commercially unacceptable.

3. A method of testing the sewing characteristics of sewing thread for determining a suitable sewing thread for sewing a seam in a particular type of fabric with a sewing machine having a vertically reciprocable needle, said method comprising;

(1) providing a supply of test strip fabric corresponding to the particular type of fabric to be seamed, (2) selecting a sewing thread having characteristics that may be suitable for forming seams in the test strip fabric, (3) feeding the test strip fabric from the supply in a predetermined path of travel and at a preselected rate of travel underneath and past the vertically reciprocable needle of the sewing machine while forming stitching thereon, (4) inverting the stitched test strip fabric after the same moves past the sewing machine needle so that the sewing machine operator then may visually inspect the bottom side of the sewn test strip fabric for the presence of stitching defects, (5) collecting the sewn test strip fabric, (6) visually inspecting the collected sewn test strip fabric for defects in the stitching formed thereon and determining the suitability of the sewing thread for use with the test strip fabric; and (7) repeating steps 3 to 6 on the test strip fabric with at least one other selected sewing thread having different characteristics and which may be suitable for forming seams in the test strip fabric should it be determined from the visual inspection of the previously collected stitched test strip fabric that stitching defects present therein are commercially unacceptable.

4. A method of testing the sewing characteristics of sewing thread for determining a suitable sewing thread for sewing a seam in a particular type of fabric with a sewing machine having a vertically reciprocable needle, said method comprising;

(1) providing at least one convolute wound roll of a test strip fabric corresponding to the particular type of fabric to be seamed, (2) selecting a sewing thread having characteristics that may be suitable for forming seams in the test strip fabric, (3) feeding the test strip fabric from the wound roll in a predetermined path of travel and at a preselected rate of travel underneath and past the vertically reciprocable needle of the sewing machine while forming stitching thereon, (4) guiding the stitched test strip fabric away from the needle of the sewing machine while inverting the stitched test strip fabric so that the sewing machine operator then may visually inspect the bottom side of the sewn test strip fabric for the presence of stitching defects, (5) collecting the sewn test strip fabric, (6) visually inspecting the collected sewn test strip fabric for defects in the stitching formed thereon and determining the suitability of the sewing thread for use with the test strip fabric; and (7) repeating steps 3 to 6 on the test strip fabric with at least one other selected sewing thread having different characteristics and which may be suitable for forming seams in the test strip fabric should it be determined from the visual inspection of the previously collected stitched test strip fabric that stitching defects present therein are commercially unacceptable.

5. A method according to any one of claims 1, 2, 3, or 4 wherein a pair of test strip fabrics is supplied and the fabrics are fed in superposed relation underneath and past the needle of the sewing machine.

6. A method according to any one of claims 1, 2, 3, or 4 including folding the test strip fabric upon itself to form a multi-layer test strip fabric prior to feeding the test strip fabric underneath the needle of the sewing machine.

7. A method according to any one of claims 1, 2, 3, or 4 including engaging the test strip fabric adjacent the needle of the sewing machine and imparting transverse reciprocatory movement to the test strip fabric so as to form a zigzag line of stitching thereon as the test strip fabric passes underneath the needle of the sewing machine.

8. A method according to any one of claims 1, 2, 3, or 4 wherein the step of feeding the test strip fabric comprises feeding the test strip fabric to and away from the stitching needle of the sewing machine so as to form an acute angular path of travel of the test strip fabric and wherein the test strip fabric passes underneath the stitching needle at an oblique angle.

9. A method according to any one of claims 1, 2, 3, or 4 including shogging the stitching needle of the sewing machine as the test strip fabric is fed thereunder to form bar tack stitching on the test strip fabric.

* * * * *